US005799351A

United States Patent [19]

Rief et al.

[11] Patent Number: 5,799,351

[45] **Date of Patent: *Sep. 1, 1998**

[54] SWIMMING POOL CLEANER WITH VIBRATORY POWER

[76] Inventors: Dieter J. Rief, 2780 Bardy Rd., Santa Rosa, Calif. 95404; Herman E. Frentzel, 424 Bee St., Sausalito, Calif. 94965; Pavel Sebor, 45 Highcliff Way, Northcliff Extension 12, Johannesburg, Transvall, South Africa

[ * ] Notice: The term of this patent shall not extend beyond the expiration date of Pat. No. 5,293,659.

[21] Appl. No.: 221,709

[22] Filed: Apr. 1, 1994

(Under 37 CFR 1.47)

Related U.S. Application Data

[63] Continuation of Ser. No. 147,993, Nov. 3, 1993, abandoned, which is a continuation of Ser. No. 145,807, Nov. 1, 1993, Pat. No. 5,379,473, which is a continuation-in-part of Ser. No. 52,699, Apr. 27, 1993, Pat. No. 5,293,659, which is a continuation of Ser. No. 771,787, Oct. 4, 1991, abandoned, which is a continuation of Ser. No. 758,005, Sep. 12, 1991, abandoned, which is a continuation-in-part of Ser. No. 586,425, Sep. 21, 1990, abandoned.

[51] Int. Cl.[6] ..... E04H 4/16

[52] U.S. Cl. ..... 15/1.7

[58] Field of Search ..... 15/1.7, 404, 419; 137/110, 112, 527.8, 527.6, 527; 251/175, 176, 59, 85; 92/125

[56] References Cited

U.S. PATENT DOCUMENTS

| | | | |
|---|---|---|---|
| 2,453,376 | 11/1948 | Lagasse | 73/194 |
| 3,803,658 | 4/1974 | Raubenheimer | 15/1.7 |
| 3,936,899 | 2/1976 | Henkin | 15/1.7 |
| 3,979,788 | 9/1976 | Strausak | 15/1.7 |
| 4,023,227 | 5/1977 | Chauvier | 15/1.7 |
| 4,133,068 | 1/1979 | Hofmann | 15/1.7 |
| 4,152,802 | 5/1979 | Chauvier | 15/1.7 |
| 4,156,948 | 6/1979 | Chauvier et al. | 15/1.7 |
| 4,275,474 | 6/1981 | Woodard | 15/1.7 |
| 4,351,077 | 9/1982 | Hofman | 15/1.7 |
| 4,409,851 | 10/1983 | Bahrton | 73/861.21 |
| 4,449,265 | 5/1984 | Hoy | 15/1.7 |
| 4,536,908 | 8/1985 | Raubenheimer | 15/1.7 |
| 4,642,833 | 2/1987 | Stoltz et al. | 15/1.7 |
| 4,686,728 | 8/1987 | Rawlins | 15/1.7 |
| 4,722,110 | 2/1988 | Chandler | 15/1.7 |
| 4,761,848 | 8/1988 | Hofmann | 15/1.7 |
| 4,778,599 | 10/1988 | Brooks | 15/1.7 |
| 4,807,318 | 2/1989 | Kallenbach | 15/1.7 |
| 4,817,225 | 4/1989 | Stoltz | 15/1.7 |
| 4,835,809 | 6/1989 | Roumagnac | 15/1.7 |
| 4,849,024 | 7/1989 | Supra | 15/1.7 |
| 4,852,211 | 8/1989 | Strausak | 15/1.7 |
| 4,920,599 | 5/1990 | Rief | 15/1.7 |
| 4,939,806 | 7/1990 | Supra | 15/1.7 |
| 5,001,800 | 3/1991 | Parenti et al. | 15/1.7 |
| 5,014,382 | 5/1991 | Kallenbach | 15/1.7 |
| 5,033,148 | 7/1991 | Chauvier et al. | 15/1.7 |
| 5,093,950 | 3/1992 | Heier | 15/1.7 |
| 5,099,535 | 3/1992 | Chauvier et al. | 15/1.7 |
| 5,293,659 | 3/1994 | Rief et al. | 15/1.7 |
| 5,371,910 | 12/1994 | Sebor | 15/1.7 |
| 5,379,473 | 1/1995 | Rief et al. | 15/1.7 |
| 5,404,607 | 4/1995 | Sebor | 15/1.7 |
| 5,428,854 | 7/1995 | Rief et al. | 15/1.7 |
| 5,469,596 | 11/1995 | Rief et al. | 15/1.7 |

FOREIGN PATENT DOCUMENTS

| | | | |
|---|---|---|---|
| 1202755 | 6/1983 | Canada . | |
| 2520422 | 7/1983 | France | 15/1.7 |
| 2604351 | 4/1988 | France | 15/1.7 |
| 648 893 | 12/1978 | Switzerland . | |

*Primary Examiner*—Gary K. Graham
*Attorney, Agent, or Firm*—Jansson, Shupe, Bridge & Munger, Ltd.

[57] ABSTRACT

A pool cleaner having an improved self-starting vibratory power source including a power-source chamber between downstream hose connection and a substantially open upstream chamber inlet and a vibrator with a downstream pivot thereon about which it pivots in the chamber, the vibrator mounted and sized such that all vibrator positions are unstable and flow is substantially unrestricted in all vibrator positions. Preferred embodiments include a drive mechanism mechanically linked to the vibratory power source.

32 Claims, 8 Drawing Sheets

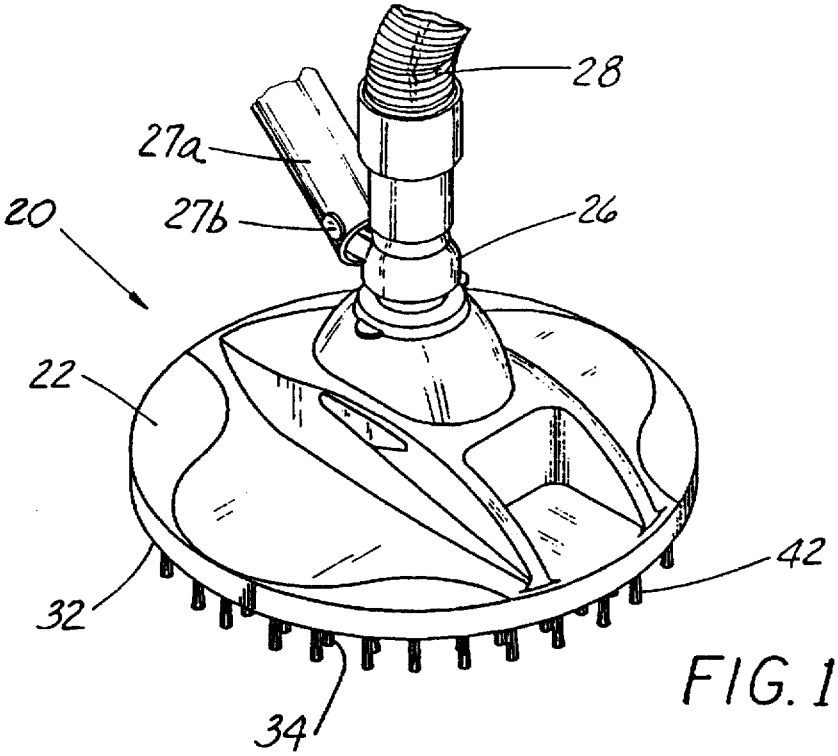
FIG. 1
FIG. 2
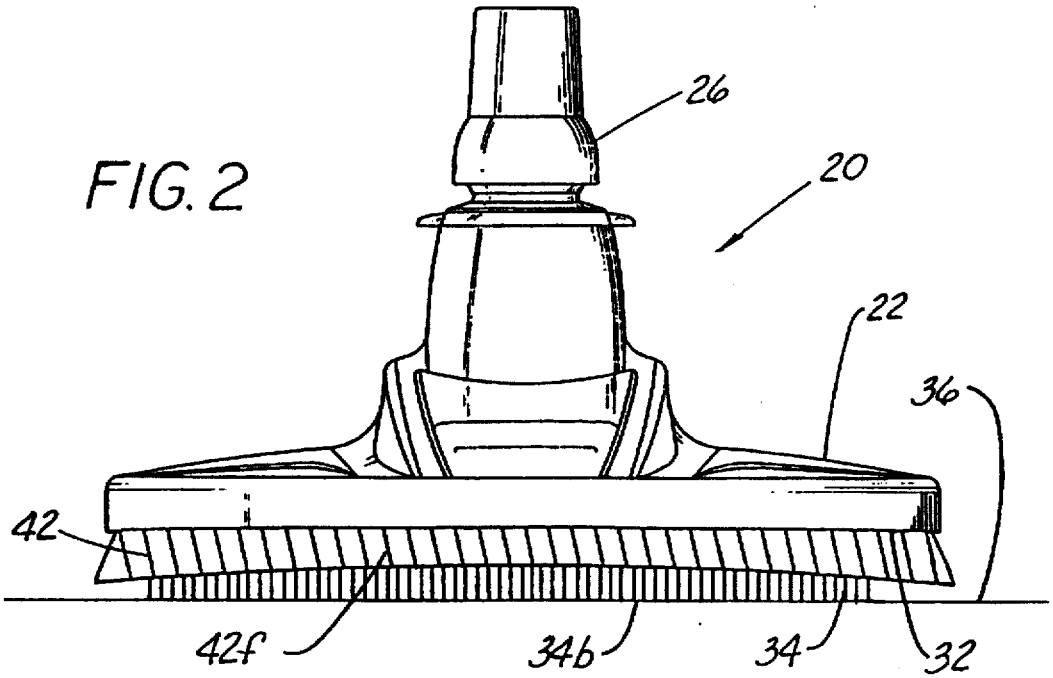

SWIMMING POOL CLEANER WITH VIBRATORY POWER

RELATED APPLICATIONS

This patent is a continuation of Ser. No. 08/147,993, filed Nov. 3, 1993 (now abandoned), which is a continuation of Pat. No. 5,379,473, granted Jan. 10, 1995, on Ser. No. 08/145,807, filed Nov. 1, 1993, which is a continuation-in-part of Pat. No. 5,293,659, entitled AN AUTOMATIC SWIMMING POOL CLEANER, granted Mar. 15, 1994, on Ser. No. 08/052,699, filed Apr. 27, 1993, which is a continuation of Ser. No. 07/771,787, filed Oct. 4, 1991 and later abandoned, which is a continuation of Ser. No. 07/758,005, filed Sep. 12, 1991 and later abandoned, which is a continuation-in-part of Ser. No. 07/586,425, filed Sep. 21, 1990 and later abandoned.

FIELD OF THE INVENTION

This invention is related generally to swimming pool cleaners and, more particularly, to swimming pool cleaners capable of operation without human assistance.

BACKGROUND IF THE INVENTION

Automatic swimming pool cleaners are widely used to relieve swimming pool owners of the time-consuming and arduous task of hand-operated vacuuming of underwater pool surfaces. Such manual task, which typically involved the use of long extension handles and clumsy manipulation of a water-suction head held under water and at a distance, have largely been made a thing of the past by automatic systems. In recent decades, many automatic swimming pool cleaners of various types have been available and in wide use around the world.

A typical automatic swimming pool cleaner has a suction head including a housing, a chamber open at its lower side, and a pivotable connector to which a long flexible hose is attached to allow movement of the swimming pool cleaner in the pool. The hose typically extends toward a remote pump which causes water flow from along the pool bottom surface, through the chamber and into the hose, removing dirt and debris from the bottom surface of the pool. The flow of water caused by the pump is harnessed in various ways to cause movement of the swimming pool cleaner.

Some of the prior devices which harness water flow to drive pool cleaners include a wide variety of turbines in the flow stream and flow-interrupting oscillating devices (which can also be considered vibratory devices). While there have been many advances in the art, there are a number of significant problems and shortcomings with apparatus of the prior art.

Certain oscillatory devices of the prior art exhibit significant starting problems. More specifically, such device, often require manual intervention (such as shaking, tilting or other rapid motion) to initiate flow-driven oscillatory motion of the power source. Thus, such devices cannot be considered to be reliably self-starting.

Another significant shortcoming of certain prior devices is a low level of power production. This is particularly important and evident when a weak pump is utilized to cause water flow through the power source. This tends to increase the pump size requirement for the pool owner and/or to make pump power insufficiently available for efficient use by the pool cleaner.

Still another problem is that prior pool cleaning devices have power sources which impose excessive loads on pumps. This occurs in part because of the substantial pressure drop across the pool cleaner, and in part because of the intermittent nature of water through the pool cleaner.

Certain devices of the prior art are complex in structure and operation, causing cost and reliability problems.

There is a clear need for improvement in pool cleaning equipment of the type using water flow to provide power for operation.

OBJECTS OF THE INVENTION

It is an object of this invention to provide a swimming pool cleaner which overcomes some of the problems and shortcomings of devices of the prior art.

Another object of this invention is to provide an swimming pool cleaner having an improved flow-driven power source.

Another object of this invention is to provide an improved swimming pool cleaner which is reliably self-starting.

Another object of this invention is to provide improved swimming pool cleaning which minimizes loads imposed on pumps and maximizes available mechanical power from its power source.

Another object of this invention is to provide an improved swimming pool cleaning apparatus which is simple in construction and operation.

Still another object of this invention is to provide a swimming pool cleaner which cleans more effectively.

Another object of this invention is to provide an improved automatic swimming pool cleaner.

Another object of this invention is to provide an improved manual swimming pool cleaning apparatus requiring less operator exertion than with certain other manual pool cleaning apparatus.

Still another object of this invention is to provide dual-use swimming pool cleaning apparatus which is free of turbines, gears, wheels and other similar moving mechanical devices.

These and other important objects will be apparent from the descriptions and drawings herein.

SUMMARY OF THE INVENTION

This invention is an improvement in swimming pool cleaning apparatus of the type having a housing open at its lower side (the upstream end of fluid flow), a hose connection (the downstream end of fluid flow) allowing water to be drawn therethrough, and a vibratory power source. More specifically, the improvement is in a vibratory power source.

In the swimming pool cleaning apparatus of this invention, the improved vibratory power source includes: a power-source chamber between an upstream chamber inlet (preferably adjacent to the housing lower side) and downstream hose connection, such power-source chamber having a substantially open upstream inlet; and a vibrator having a downstream pivot thereon by which it is pivotably mounted in the chamber, the vibrator mounted and sized such that all vibrator positions are unstable and such that flow is substantially unrestricted regardless of the position of the vibrator.

The positional instability of the vibrator enables the vibratory power source to be completely self-starting; that is, vibration begins when water flow begins, without the need for manual intervention to start oscillatory motion. Furthermore, the unrestricted nature of the flow through the power-source chamber minimizes the load imposed on the pump, which typically is remote from the pool cleaner.

In preferred embodiments, the vibrator has a concave-convex shape, with the concave surface facing upstream and the convex surface facing downstream. The pivot mount preferably defines a pivot axis, and the vibrator preferably has substantial bilateral symmetry about a central axis which is perpendicular to the pivot axis. In a particularly preferred embodiment, the vibrator is semi-cylindrical in cross-sectional shape. It is also highly preferred that the open upstream inlet and downstream hose connection of the power-source chamber have flow axes which are in alignment with the central axis when the vibrator is in its middle position.

In preferred embodiments, the open upstream inlet has a substantially larger open flow area than the downstream hose flow area. As already suggested, this minimizes load on the system pump. Furthermore, it enables the vibratory power source to generate greater power than is possible when flow is restricted. This provides more power for cleaning, movement and/or control of the pool cleaner.

The swimming pool cleaner of this invention, in preferred forms, may include various drive means thereon which are mechanically linked to the vibratory power source, such that at least some of the power generated by the vibratory power source may be used to move the pool cleaner along an underwater surface. Such drive means can include vibratory bristle drive as described in some detail herein. In such case, the mechanical linkage includes the pool cleaner housing itself as well as bristle mounts and related apparatus. Other drive means include a wide variety of mechanisms, such as spring-mounted legs driven by vibration, or wheel or tractor systems with a drive train which includes a ratchet or clutch device which links the oscillating vibrator to suitable gearing.

In certain embodiments of this invention, for example, those having bristles, power from the vibratory power source is harnessed to assist in cleaning through scrubbing action.

In certain preferred embodiments, the power-source chamber is laterally defined by a pair of opposed impact walls and a pair of sealing walls. The vibrator has a pair of upstream flow-facing edges positioned to be alternately reactive to fluid dynamic forces and two wall-facing edges adjacent to the sealing walls.

In such embodiments, each wall-facing edge preferably has a seal therealong in sealing relationship with the adjacent sealing wall and freely movable with respect to the sealing wall to accommodate passage of dirt and debris. This allows substantially all flow through the power-source chamber to contribute power to the vibratory power source.

In certain highly preferred embodiments, the wall-facing edges and the seals are arcuate (curved), and each seal has a sealing edge facing the adjacent sealing wall, a back edge, and upstream and downstream arcuate surfaces. Each wall-facing edge has a wide notch therealong on the upstream surface of the vibrator to receive one of the seals, placing the downstream arcuate surface of such seal in contact with the vibrator, leaving the upstream arcuate surface of the seal substantially free of contact with the vibrator, and exposing the back edge of the seal to the water flow at a position upstream of the vibrator.

Thus, the seal is positioned and arranged to be freely driven against the sealing wall by the differential pressure across the seal. Furthermore, the seal freely self-adjusts with respect to the sealing wall of the power-source chamber to allow passage of dirt. With this arrangement, the seal is self-cleaning, such that accumulation of dirt around the seal is avoided. This allows the seal to be operable under normal pool-cleaning conditions, that is, in the presence of dirt and debris which is being removed from underwater pool surfaces.

In particularly preferred embodiments, each wall-facing edge of the vibrator has lateral end slots which are adjacent to each of the flow-facing edges, and each seal has two ends, one resting in each of the lateral end slots. This serves to further locate the seal with respect to the vibrator.

BRIEF DESCRIPTION OF THE DRAWINGS

FIG. 1 is a perspective of a preferred swimming pool cleaner in accordance with this invention.

FIG. 2 is a front elevation of the device of FIG. 1.

Figure 4:
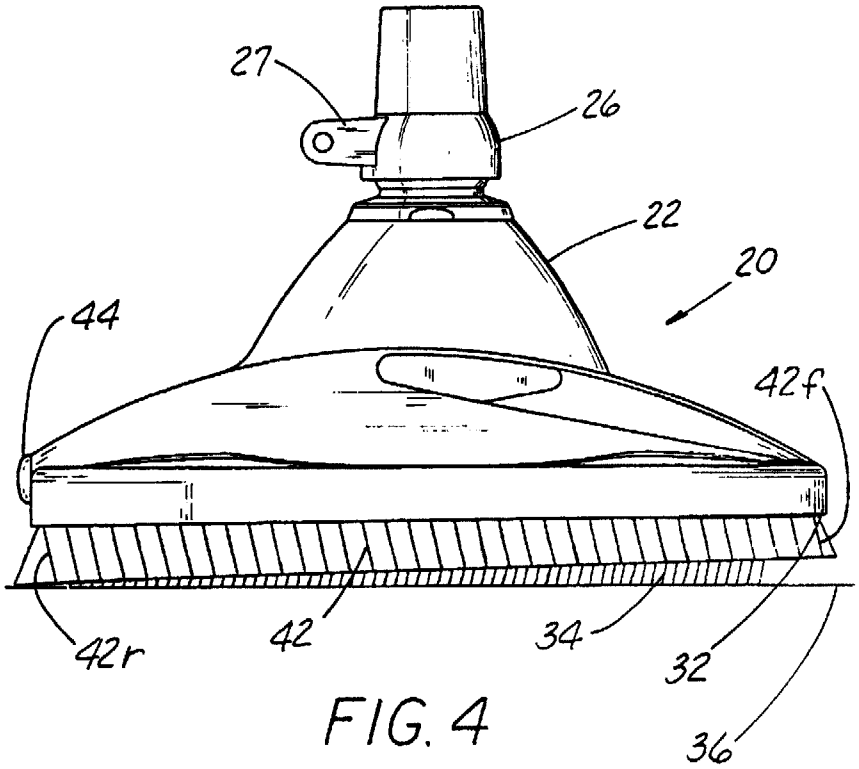
FIG. 4 is a side elevation.

As will be noted, for reasons of convenience several of the figures represent bristles somewhat schematically, rather than in actual form. The required characteristics of such bristles, however, is disclosed by such figures and by the written descriptions herein.

DETAILED DESCRIPTION OF THE PREFERRED EMBODIMENTS

FIGS. 1–16 illustrate a dual-use automatic swimming pool cleaner suction head 20 in accordance with this invention. "Dual-use" refers to the fact that suction head 20 may be used for automatic pool cleaning or manual pool cleaning, as desired.

Suction head 20 has a housing 22, a chamber 24 (see FIGS. 6, 8 and 9) which is open at the lower side of housing 22, and a pivotable hose connection 26, more specifically, a spherical joint, on housing 22 allowing pivotable connection of a hose 28 through which a remote suction pump (not shown) causes water flow through chamber 24 and into hose 28, removing dirt and debris from the underwater surface of the pool.

Lugs 27 at hose connection (spherical joint) 26 are used to removably attach an elongate handle (pole) **27*a*** to housing 22. Handle 27a is removed during automatic pool cleaning operations and attached for manual operations. Handle 27a is attached by means of a removable pin 27b.

As shown best in FIGS. 5, 6, 8 and 9, chamber 24 includes a central outflow portion (or "power-source chamber") 24a and a surrounding inflow portion 24b which extends to the periphery of housing 22. As shown in FIGS. 6–9 and 13, suction head 20 includes a vibrator 30 in power-source chamber 24a. Vibrator 30 is pivotably secured to housing 22 by means of a shaft 30a, and is designed to freely oscillate within power-source chamber 24a in response to water flow therethrough. As shown best in FIGS. 7 and 8, shaft 30a is journaled in holes 30b in housing 22 and is held in place by retainer plates 30c which are engaged with housing 22.

Figure 7:
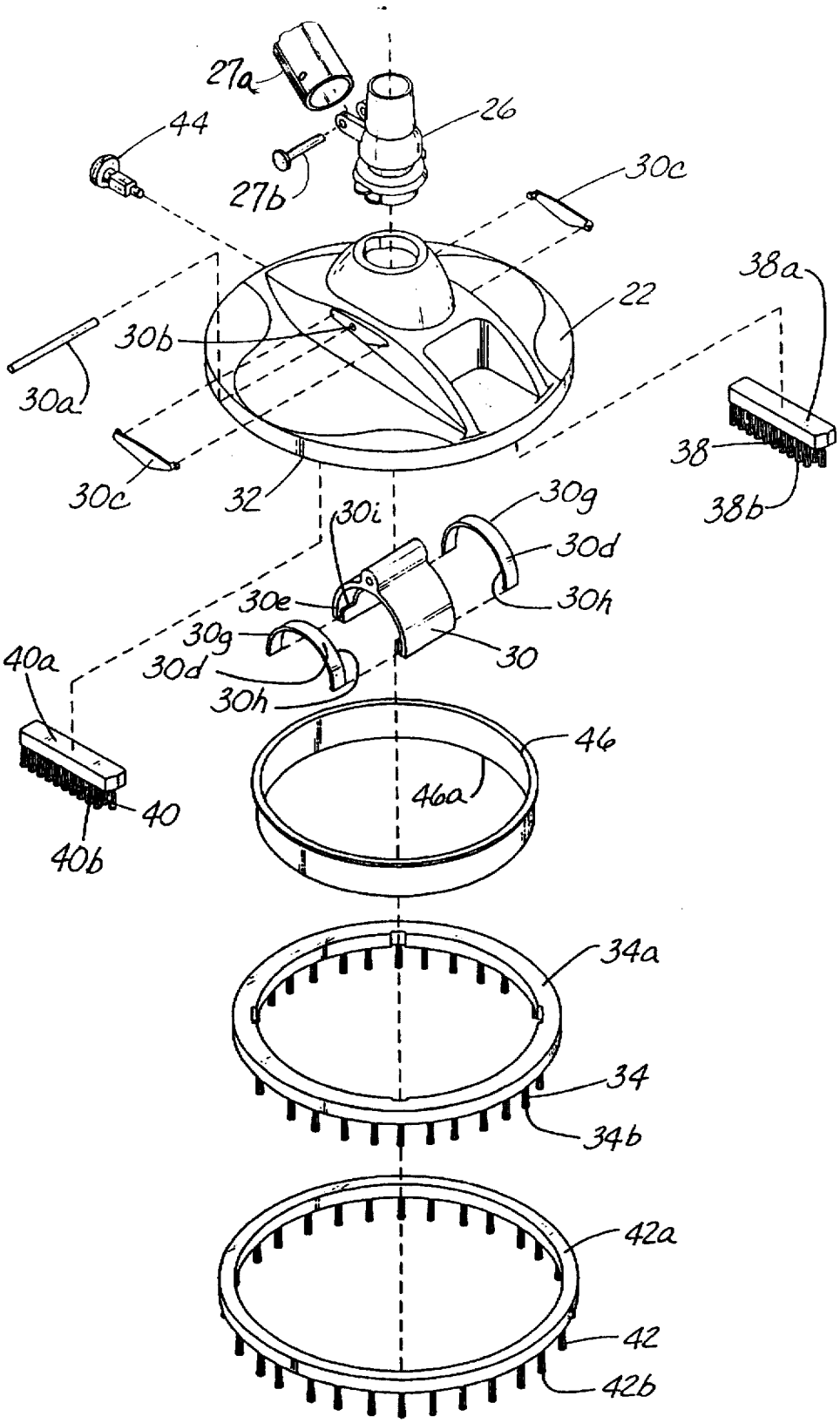
FIG. 7 is an exploded view.
Figure 9:
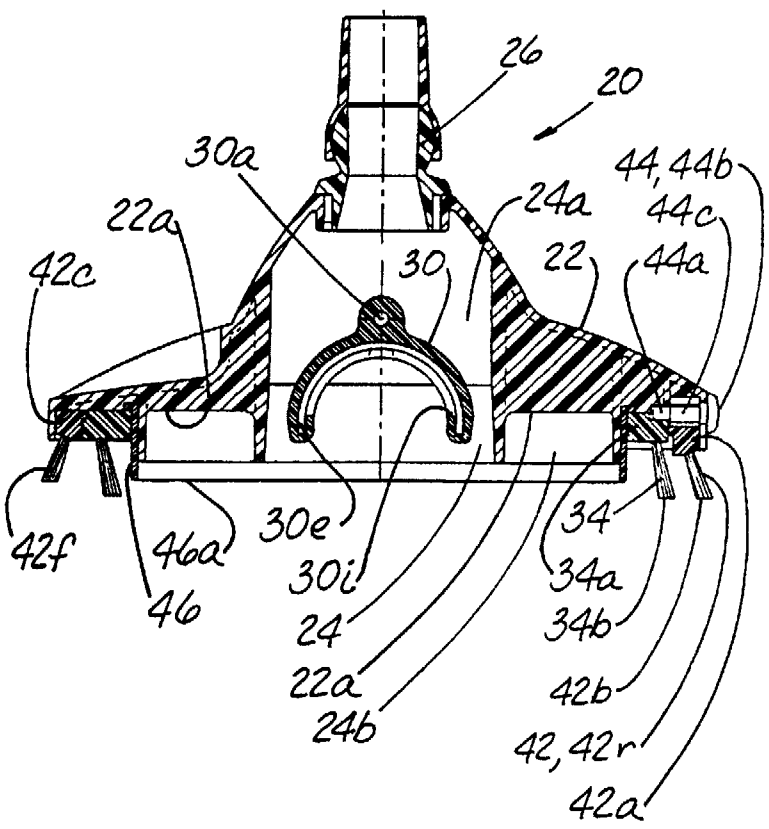
FIG. 9 is a sectional view taken along section 9—9 as indicated in FIG. 5.
Figure 13:
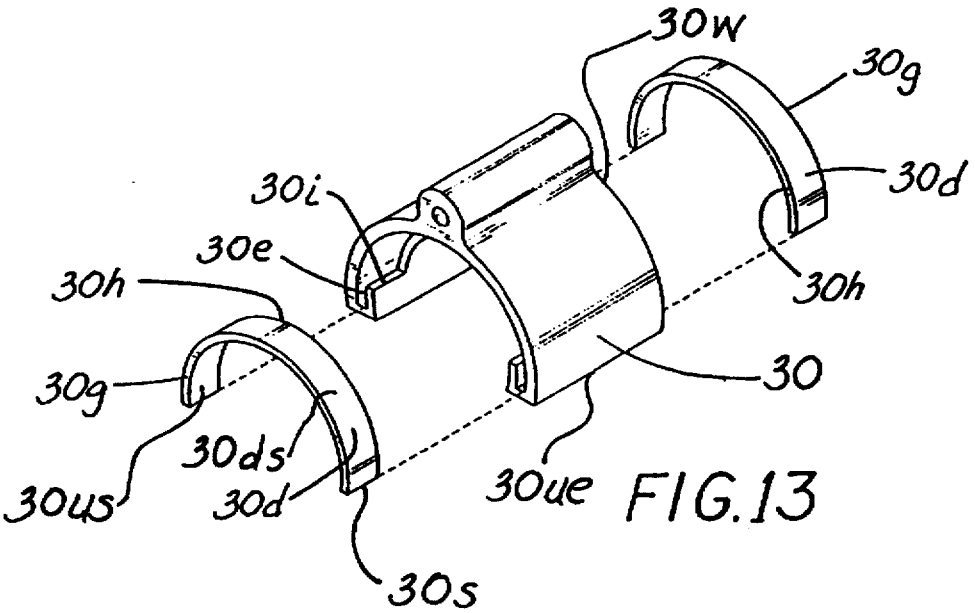
FIG. 13 is an enlarged exploded perspective view of the vibrator device.
Figure 14:
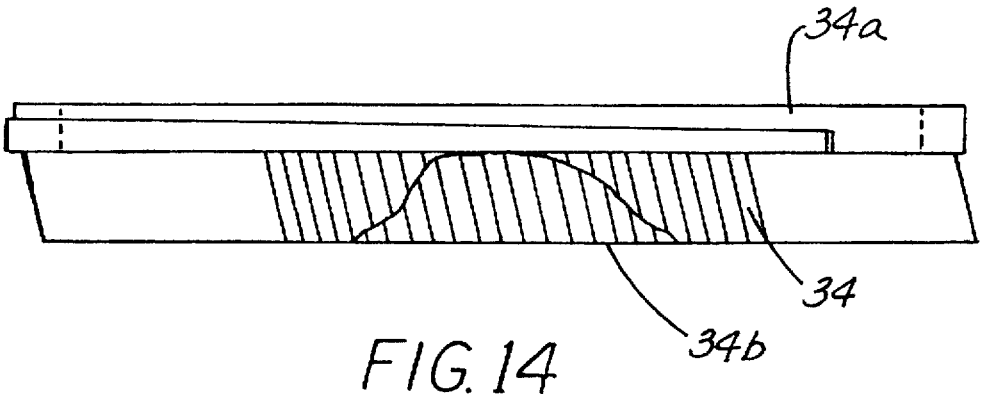
FIG. 14 is a partially cutaway side elevation of the main-bristle ring.

As shown in FIGS. 7, 9 and 13, vibrator 30 is shaped to have a hollow semi-cylindrical cross-section and is located in dome-like power-source chamber 24a, with the convex side of vibrator 30 oriented downstream toward hose connection 26. Vibrator 30 has a pair of upstream flow-facing edges 30ue, which water flows against during operation, causing vibrator 30 to pivot first in one direction and then in the other. The profile and dimensions of vibrator 30 have been developed to provide a self-starting and relatively constant speed vibration which is powered by the flow of water up toward outlet hose 28. Flow of water causes an oscillation of vibrator 30, and the oscillatory momentum and impact forces (including movements of water mass) are imparted to housing 22 to cause vibratory motion.

As shown in FIGS. 6–8 and 13, vibrator 30 has opposite wall-facing edges 30w, each of which is arcuate and forms a pair of lateral end slots 30e. Sliding seals 30d are aligned along wall-facing edges 30w. Each seal 30d has two opposite ends 30s, each of which is seated (rests in) one of the lateral end slots 30e. Seals 30d engage opposed inner side walls 30f of power-source chamber 24a, as will be described further herein. Sliding seals 30d serve to seal vibrator 30 to side walls 30f and prevent excessive by-pass of water and yet allow sand or other small particles to escape to avoid clogging and lock-up and to avoid damage to parts. Sliding seals 30d can move inwardly as necessary to accommodate the passing of sand or other particles.

Sliding seals 30d are forced toward side walls 30f by the difference in hydraulic pressure between opposite edges of each of the sliding seals. Lower pressure fluid is exposed to seal outer (or "sealing") edges 30g than is exposed to seal inner (or "back") edges 30h (see FIGS. 6, 7, 8 and 13), and the higher pressure along seal inner edges 30h pushes seals 30d outwardly toward the lower pressure or suction sides of seal 30d (that is, in the direction toward seal outer edges 30g), causing engagement with side walls 30f.

As shown in FIGS. 6–9 and 13, best in FIG. 13, seals 30d have upstream and downstream arcuate surfaces 30us and 30ds, respectively, such surfaces extending from back edge 30h to sealing edge 30g. Each wall-facing edge 30w of vibrator 30 has a wide notch 30i extending along nearly all of its length—and nearly all the length of seal 30d. Downstream arcuate surface 30ds contacts vibrator 30 and upstream arcuate surface 30us of seal 30d is substantially free of contact with vibrator 30. Back edge 30h of seal 30d is exposed to water flow upstream of vibrator 30. This configuration and arrangement allows effective operation of the pressure differential across seal 30d, which causes pressure-driven outward movement of sliding seals 30d such that sealing edge 30g properly engages walls 30f of power-source chamber 24a.

Notches 30i serve to fully expose much of the surfaces of seals 30d, allowing seals 30d to remain free to move within lateral slots 30e —by reducing or eliminating spaces where sand or dirt particles could accumulate to interfere with operation.

As already noted, vibrator 30 causes vibration of housing 22 as water passes through suction head 20. Vibration acts through inclined bristles or other like flexures to cause forward movement of suction head 20. Housing has a lower edge 32 which surrounds chamber 24, and secured along lower edge 32 are main bristles 34 such bristles forming something of an annulus of main bristles 34. More specifically, main bristles 34 are secured to a main-bristle ring 34a and such ring is removably secured to housing 22 along lower edge 32.

Figure 3:
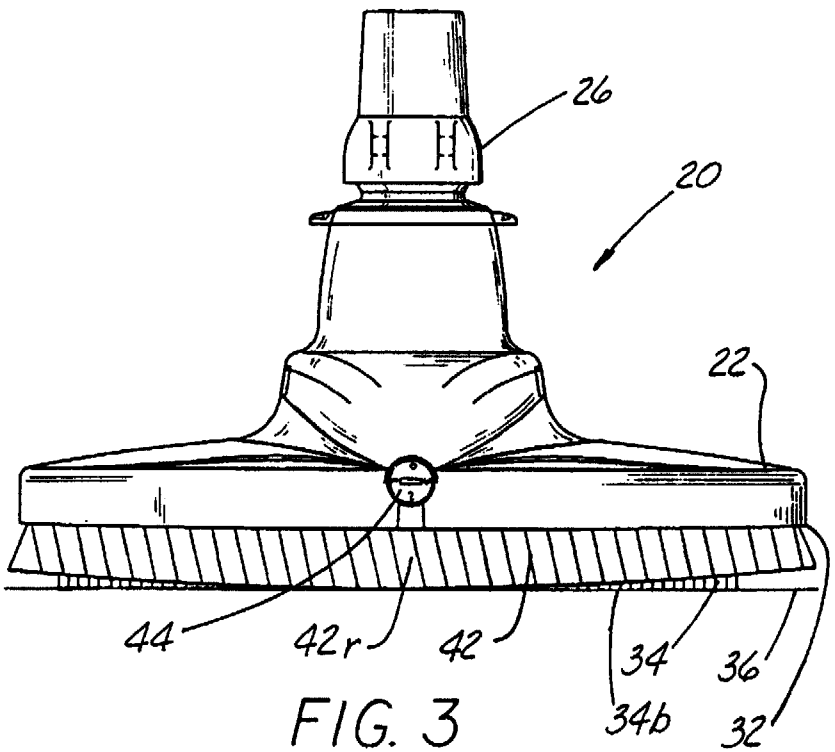
FIG. 3 is a rear elevation.

Main bristles 34 project downwardly to terminate in free main-bristle ends 34b which are disposed in a common plane and support suction head 20 on an underwater swimming pool surface to be cleaned. FIGS. 2–4 include a reference line 36 which is representative of a planar horizontal pool bottom surface, that is, a surface to be cleaned; as shown in FIGS. 2–4, such line is also representative of the common plane in which main-bristle ends 34b are disposed, given that in such views suction head 20 is supported by surface 36. The orientation of bristles will be described herein by reference to a vertical direction with respect to a horizontal surface such as that represented by reference line 35.

Main bristles 34 are affixed to main-bristle ring 34a at an angle; they deviate from vertical in a common direction at all locations about ring 34a. Such inclination, or deviation from vertical, is preferably about 8 to 18°, more preferably about 10 to 14°, with about 12° most preferred. This inclination of main bristles 34 about main-bristle ring 34a is illustrated best in FIG. 14, the breakaway portion of which shows that bristles on the far side of main-bristle ring 34a are angled in the same direction as those on the near side. Vibration of housing 22, acting through the combined rapid small motions of the many main bristles 34 about ring 34b, causes forward motion of suction head 20.

Suction head 20 has three groups of secondary bristles. These include two inside secondary-bristle groups 38 and 40 and an outer annulus of side secondary bristles 42 on secondary-bristle ring 42a. All of such secondary bristles, during operation of suction head 20, are in fixed vertical positions, although adjustment is possible with respect to bristles 42 of secondary-bristle ring 42a. All of such secondary bristles are inclined, that is, deviate with respect to the vertical direction. Such angle of inclination is preferably about 8 to 18°, more preferably about 10 to 14°, with about 12° most preferred, but such bristles are mounted so that most are inclined in a direction or directions different than the direction of inclination of main bristles 34.

As earlier described, contact of secondary-bristle ends with the surface to be cleaned as suction head 20 moves therealong such surface causes turning in the direction of movement of suction head 20. That is, the vibration causes a turning of the head away from the forward direction by virtue of the vibratory action of the secondary bristles—as with the main bristles, but in a different, and therefore turning, direction. The extent of turning depends on the extent of secondary bristle end contact with the surface to be cleaned.

Secondary-bristle groups 38 and 40 are secured to the downwardly-facing middle surface 22a of housing 22, a surface surrounded by housing lower edge 32. See FIGS. 6–9 and 16. Secondary bristle groups 38 and 40 are secured to bristle blocks 38a and 40a, respectively, which are secured with respect to housing 22 such that the bristles of bristle groups 38 and 40 are in fixed vertical positions, with their bristle ends 38*b* and 40*b* at or about at the aforementioned common plane which is defined by main-bristle ends 34*b*.

Figure 6:
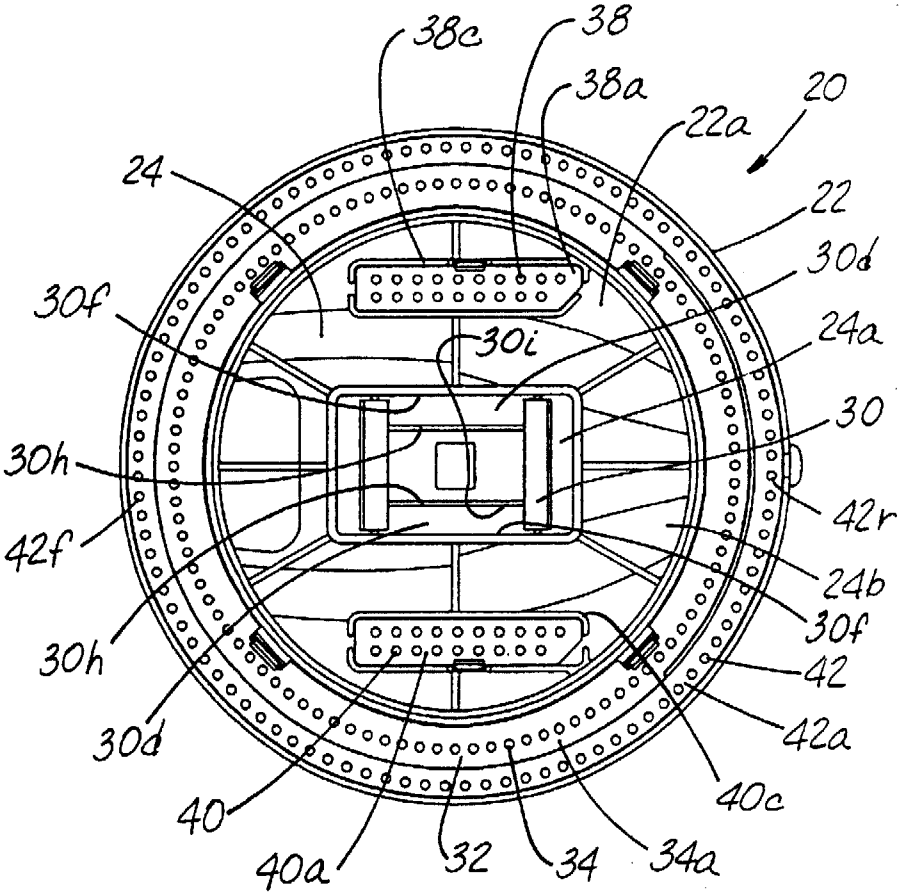
FIG. 6 is a bottom plan view.
Figure 5:
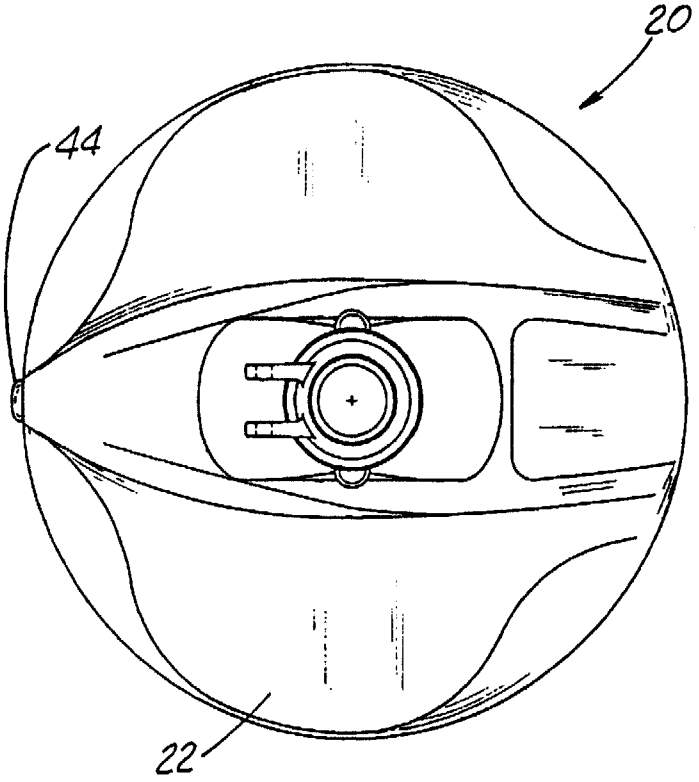
FIG. 5 is a top plan view.

As shown best in FIG. 6, bristle blocks 38*a* and 40*a* are attached within securement walls 38*c* and 40*c*, respectively, which are formed on (and are part of) downwardly-facing middle surface 22*a* of housing 22. Securement wall 38*c* is shaped with a tapered corner such that one of the bristle blocks, in this case bristle block 38*a*, can be secured therein in only one orientation—that is, with its secondary bristles 38 inclined in a direction different than the direction of inclination of main-bristles 34. Bristle block 38*a* cannot be reversed in its orientation. On the other hand, securement wall 40*c* is generally rectangular in shape without any irregular features which would limit the manner in which bristle block 40*a* is inserted therein.

Thus, bristle block 40*a* may be removed, reversed in orientation, reinserted and reattached within securement wall 40*c*, allowing its secondary bristles to be in either of at least two different orientations. The illustrated arrangement has secondary bristle groups 38 and 40 inclined in opposite directions—that is, in a common direction when considered rotationally—and this serves to impart an enhanced rotational motion to suction head 20, thus facilitating turning of suction head 22 from its direction of forward movement.

It has been found that the irregularities in the otherwise flat underwater surfaces of swimming pools—that is, portions which are off-flat or off-smooth surfaces—interact with secondary bristles as suction head 20 moves about a swimming pool under the vibratory action of main-bristles 34. More turning is achieved if the ends of the secondary bristles protrude more from the bottom of housing 22; less turning is achieved if the secondary-bristle ends are recessed a bit. It has been found that locating secondary bristle groups 38 and 40 such that bristle ends 38*b* and 40*b* are at or very near the aforementioned common plane provides ample random turning action. This turning action can be either enhanced or controlled by reversal of the orientation of bristle group 40.

Figure 8:
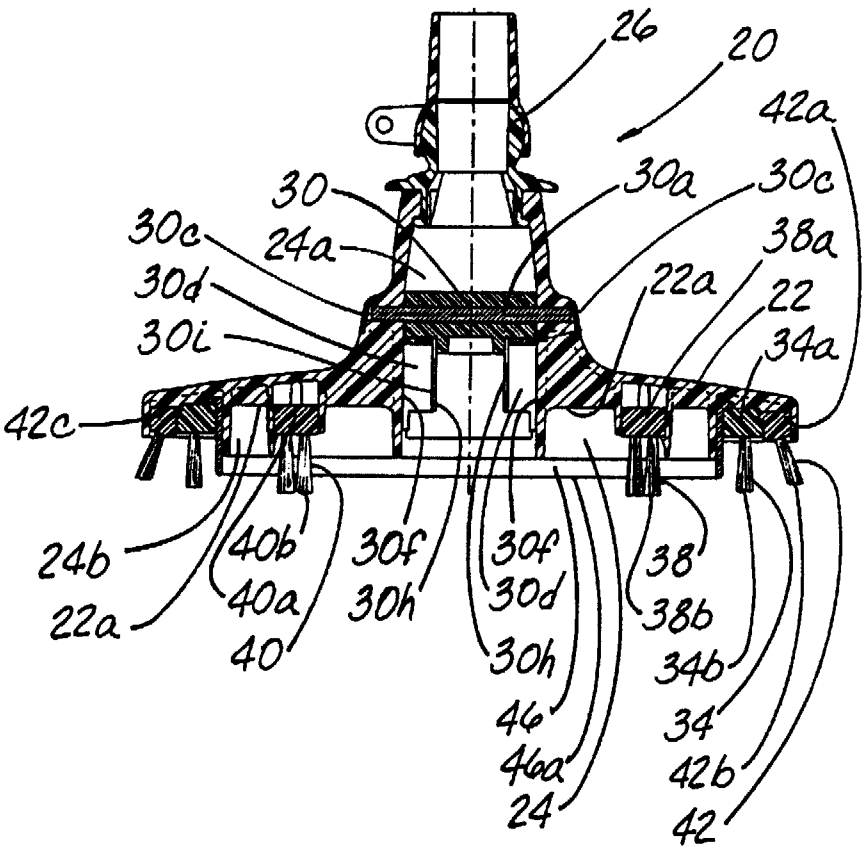
FIG. 8 is a sectional view taken along section 8—8 as indicated in FIG. 5.
Figure 12:
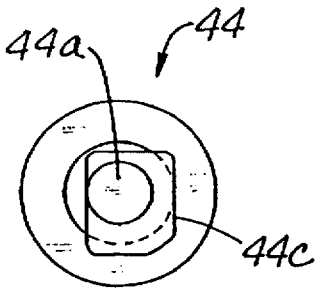
FIG. 12 is a left side elevation of FIG. 10, showing the other end of the height adjustment device.
Figure 10:
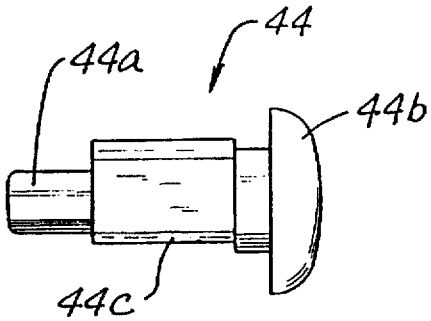
FIG. 10 is a side view of an adjustment device for which is used for adjusting the vertical position of a portion of the secondary-bristle ring.
Figure 11:
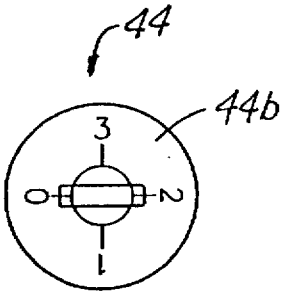
FIG. 11 is a right side elevation of FIG. 10, showing the head of the adjustment device.

As shown in FIGS. 2–4 and 6–9, best in FIGS. 8 and 9, ring 42*a* to which secondary bristles 42 (that is, "side" secondary bristles) are secured, is secured to housing lower edge 32 in a position which is concentric with main-bristle ring 34*a* at a position outside (that is, radially outside) main-bristle ring 34*a*. Both rings 34*a* and 42*a* are removably secured along lower edge 32, and may therefore be replaced when worn.

Figure 15:
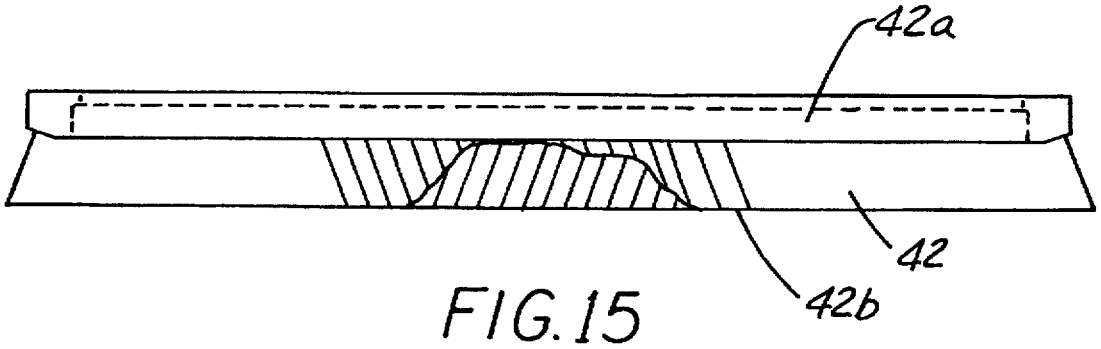
FIG. 15 is a partially cutaway side elevation of the secondary-bristle ring.
Figure 16:
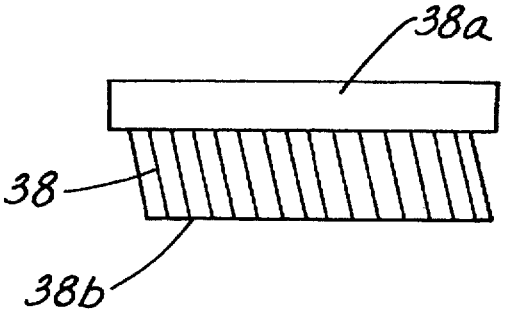
FIG. 16 is a partially cutaway side elevation of a secondary-bristle group.

Side secondary bristles 42 project both outwardly and downwardly and terminate short of the common plane indicated by reference line 36 (in FIGS. 2–4). As shown in FIG. 15, which includes a breakaway portion allowing illustration of bristle orientations on both the near side and the far side of secondary-bristle ring 42*a*, secondary bristles 42 are disposed at a common rotational angle—about 12° to vertical—such that engagement of bristle ends 42*b* with pool bottom surfaces causes a turning deflection of suction head 20. And, in addition to such rotational angle, bristles 42 are oriented to project radially outwardly, preferably about 16 to 24° from vertical, most preferably about 20°. This facilitates engagement with pool side walls as they are approached by suction head 20, and the combination of rotational and radial angling causes turning of suction head 20 when such bristles hit a side wall.

As shown in FIGS. 2–4, 6 and 9, secondary-bristle ring 42*a* is in a tilted orientation such that the ends of its rear bristles 42*r*, that is, its bristles generally along the rear circumferential portion of ring 42*a*, are at a lower position than are the ends of its front bristles 42*f*, that is, its bristles generally along the front circumferential portion of ring 42. The ends of the bristles of secondary-bristle ring 42 at circumferential portions between the front and the rear are at levels therebetween. The rear circumferential portion of secondary-bristle ring 42*a* is referred to herein as a low circumferential portion. Its level is because of the tilt of ring 42; all bristles 42 are of substantially equal lengths.

Not only is ring 42*a* tilted, but the extent of tilt of ring 42*a* is adjustable. As shown in FIGS. 8 and 9, the upper surface of ring 42*a* is against ring-placement surface 42*c* which is part of the under surface of housing 22 along housing lower edge 32. Ring-placement surface 42*c*, while planar, is tilted with respect to a horizontal plane such that ring 42*a* is tilted.

As illustrated best in FIG. 9, between the rear circumferential portion of ring 42*a* and the adjacent portion of ring-placement surface 42*c* is a tilt-adjuster 44. Tilt-adjuster 44, shown in detail in FIGS. 10–12, has an inner end which is rotatably secured to housing 22, an outer end 44*b* by which the rotational orientation of tilt-adjuster 44 is set (for example, by using a screw driver), and a middle camming portion 44*c*. As shown best in FIG. 12, camming portion 44*c* has four sides, each of such sides having a different spacing from the axis of tilt-adjuster 44.

In the embodiment illustrated, tilt-adjuster 44 adjusts the tilt of secondary-bristle ring 42*a* between an orientation in which the ends of rear bristles 42*r* are at about the level of common plane 36 (and, thus, at about the level of main-bristle ends 34*b*) and an orientation in which the ends of rear bristles 42*r* are about three millimeters above common plane 36. Adjustments can be made to intermediate positions in which the ends of rear bristles 42*r* are either one or two millimeters above common plane 36. Outer end 44*b* of tilt-adjuster 44 is marked as a guide for such adjustment. When in its highest position of adjustment, the ends of front bristles 42*f* are still at a level about three millimeters above the level of the ends of rear bristles 42*r*.

This adjustability in the vertical positions of secondary-bristle ends 42*b* provides a further way to assure that the turning action provided by the secondary bristles of suction head 20 is appropriate for effective cleaning of a particular swimming pool.

As illustrated in FIGS. 6–9, a skirt 46, which is concentric with bristle rings 34*a* and 42*a*, projects downwardly from housing 22 at a position radially inside main-bristle ring 34. Bristle rings 34*a* and 42*a* and skirt 46 are configured and dimensioned for engagement with one another to facilitate assembly of suction head 20. Skirt 46 extends downwardly to a skirt lower edge 46*a* which is spaced well above the ends of both main bristles 34 and secondary bristles 42, that is, above the ends of the bristles of both bristle rings. Such spacing determines the gap through which water and debris will pass in entering housing chamber 24, and the gap must be small enough to assure sufficient turbulence of water flow at and between bristles as they engage the pool surface to be cleaned, and large enough to allow passage of dirt and debris.

Figure 17:
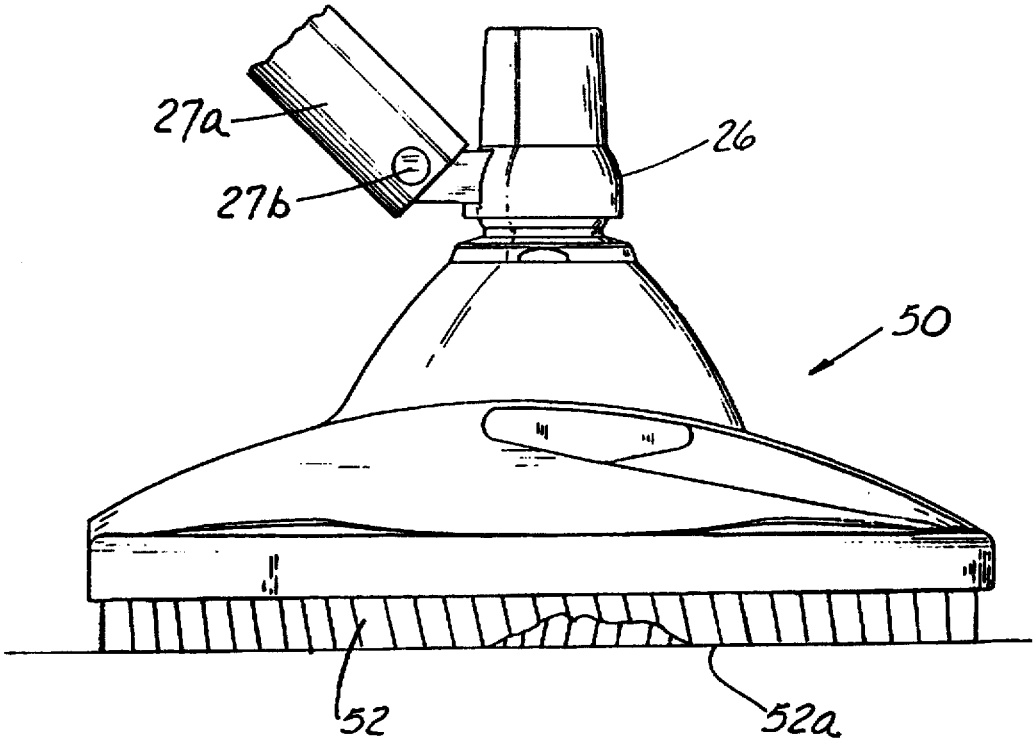
FIG. 17 is a side elevation of a preferred manual pool cleaner utilizing this invention.

FIG. 17 illustrates a simpler suction head 50 which is designed for manual use. Suction head 50 has a single removable ring of bristles 52 about the lower edge of its housing. Unlike suction head 20, suction head 50 has no tilt adjustment feature. However, in most other respects, including the presence of vibrator 30, suction head 50 is similar to suction head 20 of the dual-use automatic pool cleaner described above.

Bristles 52 are similar to secondary bristles 42 (described above) in that they are disposed at a common rotational angle—about 12° to vertical—such that engagement of bristle ends 52*a* with underwater pool surfaces causes a turning deflection of suction head 50. Such turning, which occurs while the operator grips handle 27*a* to manipulate suction head 50, is allowed to occur by virtue of the aforementioned spherical joint 26. Furthermore, such turning is facilitated by the vibratory forces described above. The turning of suction head 50 provides enhanced scrubbing action.

Unlike secondary bristles 42, bristles 52 are not outwardly (radially) inclined; they are only rotationally inclined; that is, bristles 52 are essentially tangential to an imaginary cylinder generally at their location and each bristle is generally along a line which is a skew line with respect to the axis which is defined by the bristle ring. Outward (radial) inclination of the bristles would be acceptable, but for a manual-use pool cleaner such inclination would provide no important advantage.

In certain embodiments, the bristles of a manual cleaner need not be inclined, either rotationally or outwardly. Vibratory action alone is sufficient to enhance the cleaning action. Furthermore, movement of the suction head along underwater surfaces tends to be facilitated by such vibratory action.

Many variations are possible in arrangement and configuration of bristles and other parts as required. The parts of this apparatus described herein may be made using known materials and molding and forming methods well known to those skilled in the art. The housings, vibrators, hose connectors, tilt-adjuster, and the rings and blocks for bristle mounting are preferably made of suitable rigid plastics. The housings can be molded with all or most of their required functional elements and features integrally formed as parts or features thereof. The bristles are preferably made of common bristle materials which are flexible and resilient, and thus facilitate the moving actions described above. Sliding seals 30*d* are made of fairly rigid seal materials, one preferred material being a Dupont Delrin acetal material.

A wide variation of materials, part manufacturing methods and assembly methods can be used.

While the principles of this invention have been described in connection with specific embodiments, it should be understood clearly that these descriptions are made only by way of example and are not intended to limit the scope of the invention.

We claim:

1. In a pool cleaner having a housing open at a lower side thereof, a hose connection on the housing allowing water to be drawn therethrough thereby defining a flow, and a vibratory power source, the power source improvement comprising:

a power-source flow chamber secured with respect to the housing between an upstream chamber inlet and downstream hose connection, having an open upstream inlet end configured such that flow into and through the chamber is not restricted by the upstream inlet end configuration alone; and a vibrator having a pivot mount thereon by which it is pivotably mounted in the chamber for oscillation between end vibrator positions determined by the power source chamber, the vibrator having a pair of opposite surfaces positioned to be alternately reactive to fluid dynamic forces, and the vibrator being mounted and sized such that total cross-sectional flow area past the vibrator is substantially unchanged in all vibrator positions and flow is substantially unrestricted in all vibrator positions.

2. The pool cleaner of claim 1 wherein the vibrator has a substantially conclave-lower-surface/convex-upper-surface shape, the concave lower surface facing upstream.

3. The pool cleaner of claim 2 wherein the pivot mount defines a pivot axis and the vibrator has substantial bilateral symmetry about a central axis perpendicular to the pivot axis.

4. The pool cleaner of claim 3 wherein the vibrator is substantially semi-cylindrical in cross-sectional shape transverse to the pivot axis.

5. The pool cleaner of claim 4 wherein the open upstream inlet and downstream hose connection have flow axes which are in alignment with the central axis when the vibrator is in a middle position.

6. The pool cleaner of claim 2 wherein the pivot mount defines a pivot axis which is substantially horizontal when the pool cleaner is on a horizontal surface and the open upstream inlet and downstream hose connection have flow axes which, when the vibrator is in a middle position, are in alignment with a central axis which intersects the pivot axis and is substantially vertical when the pool cleaner is an a horizontal surface.

7. The pool cleaner of claim 1 wherein the pivot mount defines a pivot axis which is substantially horizontal when the pool cleaner is on a horizontal surface and the open upstream inlet and downstream hose connection have flow axes which, when the vibrator is in a middle position, are in alignment with a central axis which intersects the pivot axis and is substantially vertical when the pool cleaner is on a horizontal surface.

8. The pool cleaner of claim 7 wherein the vibrator has substantial bilateral symmetry about the central axis.

9. The pool cleaner of claim 1 further comprising a drive mechanism thereon linked indirectly with respect to the vibrator solely by attachment of said drive mechanism to the housing, whereby at least some of the power generated by the vibratory power source is used to move the pool cleaner along an underwater surface.

10. The pool cleaner of claim 1 wherein:

the power-source flow chamber is laterally defined by a pair of opposed impact walls and a pair of sealing walls; and the vibrator has a pair of upstream flow-facing edges and two wall-facing edges adjacent to the sealing walls.

11. The pool cleaner of claim 10 wherein each wall-facing edge has a seal therealong in sealing relationship with the sealing wall adjacent thereto and freely movable with respect to the sealing wall to accommodate passage of dirt and debris, whereby substantially all flow contributes power to the vibratory power source.

12. The pool cleaner of claim 11 wherein:

the wall-facing edges and the seals are arcuate;

each seal has a sealing edge facing the adjacent sealing wall, a back edge, and upstream and downstream arcuate surfaces;

each wall-facing edge is notched therealong to receive one of the seals with the downstream arcuate surface in contact with the vibrator, the upstream arcuate surface substantially free of contact with the vibrator, and the back edge substantially exposed to flow upstream of the vibrator;

whereby the seal is freely driven against the sealing wall by pressure differentials, freely self-adjusts to allow passage of dirt, and prevents accumulation of dirt.

13. The pool cleaner of claim 12 wherein:

each wall-facing edge of the vibrator has lateral end slots adjacent to each of the flow-facing edges; and each seal has two ends, each end resting in one of the lateral end slots to locate the seal with respect to the vibrator.

14. The pool cleaner of claim 12 wherein the vibrator has a substantially concave-lower-surface/convex-upper-surface shape, the concave lower surface facing upstream.

15. The pool cleaner of claim 14 wherein the pivot mount defined a pivot axis and the vibrator has substantial bilateral symmetry about a central axis which intersects and is perpendicular to the pivot axis.

16. The pool cleaner of claim 15 wherein the vibrator is substantially semi-cylindrical in cross-sectional shape transverse to the pivot axis.

17. The pool cleaner of claim 16 wherein the open upstream inlet and downstream hose connection have flow axes which, when the vibrator is in a middle position, are in alignment with a central axis which intersects the pivot axis and is substantially vertical when the pool cleaner is on a horizontal surface.

18. The pool cleaner of claim 1 wherein the vibrator is free of direct mechanical propulsion-drive linkage.

19. The pool cleaner of claim 1 wherein the vibrator is free of direct mechanical propulsion-drive linkage in the power-source chamber.

20. The pool cleaner of claim 1 wherein the power-source flow chamber is free of substantial flow obstruction therein upstream of the vibrator.

21. In a pool cleaner having a housing open at a lower side thereof, a hose connection on the housing allowing water to be drawn therethrough, and a vibratory power source, the power source improvement comprising:

a power-source flow chamber secured with respect to the housing between an upstream chamber inlet and downstream hose connection, the chamber having a transverse cross-sectional area and a substantially open upstream inlet of similar cross-sectional area; and a vibrator of substantially concave-lower-surface/convex-upper-surface shape, the concave lower surface facing upstream, and having a pivot mount thereon by which it is pivotably mounted in the chamber for oscillation between end vibrator positions determined by the power source chamber, the vibrator having a pair of opposite surfaces positioned to be alternately reactive to fluid dynamic forces, and the vibrator being mounted and sized such that total cross-sectional flow area past the vibrator is substantially unchanged in all vibrator positions and flow is substantially unrestricted in all vibrator positions.

22. The pool cleaner of claim 21 wherein the pivot mount defines a pivot axis and the vibrator has substantial bilateral symmetry about a central axis perpendicular to the pivot axis.

23. The pool cleaner of claim 22 wherein the vibrator is substantially semi-cylindrical in cross-sectional shape transverse to the pivot axis.

24. The pool cleaner of claim 23 wherein the open upstream inlet and downstream hose connection have flow axes which are in alignment with the central axis when the vibrator is in a middle position.

25. The pool cleaner of claim 21 wherein the pivot mount defines a pivot axis which is substantially horizontal when the pool cleaner is on a horizontal surface and the open upstream inlet and downstream hose connection have flow axes which, when the vibrator is in a middle position, are in alignment with a central axis which intersects the pivot axis and is substantially vertical when the pool cleaner is on a horizontal surface.

26. The pool cleaner of claim 21 wherein:

the power-source flow chamber is laterally defined by a pair of opposed impact walls and a pair of sealing walls; and the vibrator has a pair of upstream flow-facing edges and two wall-facing edges adjacent to the sealing walls.

27. The pool cleaner of claim 26 wherein each wall-facing edge has a seal therealong in sealing relationship with the sealing wall adjacent thereto and freely movable with respect to the sealing wall to accommodate passage of dirt and debris, whereby substantially all flow contributes power to the vibratory power source.

28. The pool cleaner of claim 27 wherein:

the wall-facing edges and the seals are arcuate;

each seal has a sealing edge facing the adjacent sealing wall, a back edge, and upstream and downstream arcuate surfaces;

each wall-facing edge is notched therealong to receive one of the seals with the downstream arcuate surface in contact with the vibrator, the upstream arcuate surface substantially free of contact with the vibrator, and the back edge substantially exposed to flow upstream of the vibrator;

whereby the seal is freely driven against the sealing wall by pressure differentials, freely self-adjusts to allow passage of dirt, and prevents accumulation of dirt.

29. The pool cleaner of claim 28 wherein the pivot mount defines a pivot axis and the vibrator has substantial bilateral symmetry about a central axis which intersects and is perpendicular to the pivot axis.

30. The pool cleaner of claim 29 wherein the vibrator is substantially semi-cylindrical in cross-sectional shape transverse to the pivot axis.

31. The pool cleaner of claim 30 wherein the open upstream inlet and downstream hose connection have flow axes which, when the vibrator is in a middle position, are in alignment with a central axis which intersects the pivot axis and is substantially vertical when the pool cleaner is on a horizontal surface.

32. The pool cleaner of claim 28 wherein:

each wall-facing edge of the vibrator has lateral end slots adjacent to each of the flow-facing edges; and each seal has two ends, each end resting in one of the lateral end slots to locate the seal with respect to the vibrator.

* * * * *

UNITED STATES PATENT AND TRADEMARK OFFICE

CERTIFICATE OF CORRECTION

PATENT NO. : 5,799,351

DATED : September 1, 1998

INVENTOR(S) : Dieter J. Rief et al.

It is certified that error appears in the above-identified patent and that said Letters Patent is hereby corrected as shown below:

In column 1, line 54, change "device" to --devices--.

In column 9, line 57, insert --the chamber-- after "connection,".

In column 10, line 24, change "an" to --on--.

Signed and Sealed this

Eighth Day of December, 1998

*Attest:*

*Attesting Officer*

BRUCE LEHMAN

*Commissioner of Patents and Trademarks*